US005957105A

United States Patent [19]

Tsunoda et al.

[11] Patent Number: 5,957,105

[45] Date of Patent: Sep. 28, 1999

[54] ENGINE FOR OUTBOARD ENGINE SYSTEM

[75] Inventors: Masaki Tsunoda; Tetsu Wada, both of Wako, Japan

[73] Assignee: Honda Giken Kogyo Kabushiki Kaisha, Tokyo, Japan

[21] Appl. No.: 09/017,811

[22] Filed: Feb. 3, 1998

[30] Foreign Application Priority Data

Feb. 3, 1997 [JP] Japan ..... 9-020454

[51] Int. Cl.[6] ..... F02F 7/00

[52] U.S. Cl. ..... 123/195 P; 123/196 W

[58] Field of Search ..... 123/195 P, 196 W, 123/195 HC, 41.74; 440/88, 900

[56] References Cited

U.S. PATENT DOCUMENTS 5,524,584 6/1996 Wantanabe ..... 123/196 W 5,553,586 9/1996 Koishikawa et al. ..... 123/196 W

FOREIGN PATENT DOCUMENTS 3-31094 2/1991 Japan .

*Primary Examiner*—Noah P. Kamen

*Attorney, Agent, or Firm*—Nikaido, Marmelstein, Murray & Oram LLP

[57] ABSTRACT

A cylinder head is coupled to a cylinder block/cylinder head coupling surface of a cylinder block by ten bolts which are disposed to surround outer peripheries of cylinders. In order to enhance sealability of an opening of an oil passage defined radially outside the bolts as viewed from the cylinders, the cylinder block and the cylinder head are further fastened to each other by two bolts disposed in the vicinity of the opening. Thus, the fastening force of the cylinder block/cylinder head coupling surface can be increased to increase the degree of freedom in design of the opening of the oil passage defined in the coupling surface.

2 Claims, 11 Drawing Sheets

ENGINE FOR OUTBOARD ENGINE SYSTEM

BACKGROUND OF THE INVENTION

1. Field of the Invention

The present invention relates to an engine for an outboard engine system comprising a cylinder head coupled to a cylinder block by a plurality of first coupling bolts disposed at substantially equal distances from a cylinder axis so as to surround an outer periphery of a cylinder. An oil passage having an opening which is defined in a cylinder head/cylinder block coupling surface is disposed at a location radially outside the first coupling bolts as viewed from the cylinder axis.

2. Description of the Related Art

An engine for an outboard engine system is disclosed in Japanese Patent Application Laid-open No. 3-31094, in which an exhaust passage is vertically defined on one side of a cylinder block in which a crankshaft is vertically supported. If the exhaust passage is vertically defined on one side of the cylinder block in this manner, exhaust gas from the engine mounted at an upper portion of the outboard engine system can be easily guided into an exhaust gas expanding chamber within an extension case mounted at a lower portion of the outboard engine system.

If cylinder bores are enlarged following an increase in size of the engine for the outboard engine system, the fastening force coupling the cylinder block and cylinder head at the coupling surface may be weakened, resulting in a reduced sealability, in some cases, unless the number of bolts for coupling the cylinder head to the cylinder block is increased and/or the diameter of the bolts is increased.

SUMMARY OF THE INVENTION

Accordingly, it is an object of the present invention to enhance the sealability of the cylinder head/cylinder block coupling surface.

To achieve the above object, according to a first aspect and feature of the present invention, there is provided an engine for an outboard engine system. The invention comprises a cylinder head coupled to a cylinder block by a plurality of first coupling bolts disposed at substantially equal distances from a cylinder axis so as to surround an outer periphery of a cylinder. An oil passage having an opening which is defined in a cylinder head/cylinder block coupling surface is disposed at a location radially outside the first coupling bolts as viewed from the cylinder axis. The cylinder head is fastened to the cylinder block by second coupling bolts disposed radially outside the first coupling bolts in the vicinity of the opening of the oil passage.

With the above arrangement, even if the oil passage which opens into the cylinder head/cylinder block coupling surface is located radially outside the first coupling bolts, when the cylinder head is coupled to the cylinder block by the plurality of first coupling bolts disposed to surround the outer periphery of the cylinder, the fastening force at the coupling surface can be increased to enhance the degree of freedom in design such as the shape and position of the opening of the oil passage. This result is obtained by fastening the cylinder head to the cylinder block by second coupling bolts disposed radially outside the first coupling bolts in the vicinity of the opening of the oil passage.

According to a second aspect and feature of the present invention, in addition to the first feature, an opening of a cooling water passage is defined in the cylinder head/cylinder block coupling surface, and at least one of the second bolts is disposed between the opening of the cooling water passage and the opening of the oil passage.

With the above arrangement, if the oil passage and the cooling water passage open into the cylinder head/cylinder block coupling surface, there is a possibility that the sealing between the oil passage and the cooling water passage may be insufficient. However, by one of the second coupling bolts being disposed between the opening of the cooling water passage and the opening of the oil passage, the sealability between the oil passage and the cooling water passage is enhanced.

The above and other objects, features and advantages of the present invention will become apparent from the following description of the preferred embodiment.

BRIEF DESCRIPTION OF THE DRAWINGS

FIG. 1 to 12 illustrate an embodiment of the present invention, wherein

FIG. 1 is a right side view of the entire outboard engine system;

FIG. 2 is a left side view of an engine;

FIG. 3 is an enlarged sectional view taken along a line 3—3 in FIG. 2;

FIG. 4 is an enlarged sectional view taken along a line 4—4 in FIG. 2;

FIG. 5 is a sectional view taken along a line 5—5 in FIG. 4;

FIG. 6 is a sectional view taken along a line 6—6 in FIG. 4;

FIG. 7 is a sectional view taken along a line 7—7 in FIG. 2;

FIG. 8 is a sectional view taken along a line 8—8 in FIG. 2;

FIG. 9 is a sectional view taken along a line 9—9 in FIGS. 4 and 7;

FIG. 10 is a sectional view taken along a line 10—10 in FIGS. 4 and 7;

FIG. 11 an enlarged sectional view of an essential portion shown in FIG. 1; and FIG. 12 is a skeleton diagram of a cooling system.

DETAILED DESCRIPTION OF THE PREFERRED EMBODIMENT

The present invention will now be described by way of an embodiment with reference to the accompanying drawings.

Figure 1:
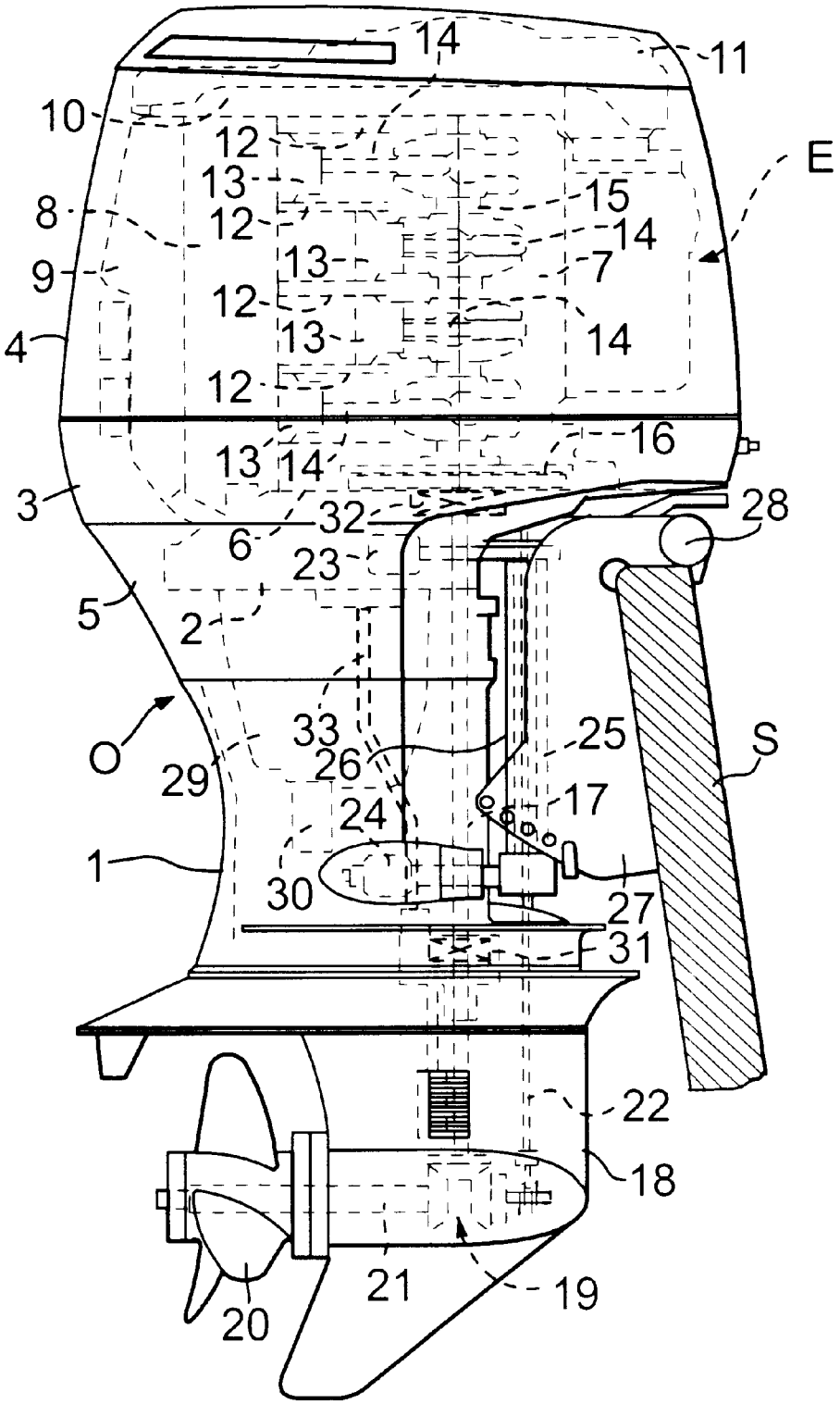

Referring to FIG. 1, an outboard engine system O includes a mount case 2 coupled to an upper portion of an extension case 1, and a water-cooled in-line type 4-cylinder and 4-cycle engine E is carried on an upper surface of the mount case 2 with its crankshaft 15 arranged vertically. An under-case 3 with an upper surface opened is coupled to the mount case 2, and an engine cover 4 is detachably mounted to an upper portion of the under-case 3. An under-cover 5 is mounted between a lower edge of the under-case 3 and an edge of the extension case 1 near its upper end to cover the outside of the mount case 2.

The engine E includes a cylinder block 6, a crankcase 7, a cylinder head 8, a head cover 9, a lower belt cover 10 and an upper belt cover 11. Lower surfaces of the cylinder block 6 and the crankcase 7 are supported on the upper surface of the mount case 2. Pistons 13 are slidably received in four cylinders 12 defined in the cylinder block 6 and are connected to the vertically disposed crankshaft 15 through connecting rods 14, respectively.

A driving shaft 17, which is connected to a lower end of the crankshaft 15 along with a flywheel 16, extends downwards through the inside of the extension case 1, with its lower end being connected to a propeller shaft 21 having a propeller 20 at its rear end, through a bevel gear mechanism 19 mounted within a gear case 18. A shift rod 22 is connected at its lower end to a front portion of the bevel gear mechanism 19 to switch over the direction of rotation of the propeller shaft 21.

A swivel shaft 25 is fixed between an upper mount 23 provided on the mount case 2 and a lower mount 24 provided on the extension case 1, and a swivel case 26 for rotatably supporting the swivel shaft 25 is vertically swingably supported on a stern bracket 27 mounted at a stern S through a tilt shaft 28.

An oil pan 29 and an exhaust pipe 30 are coupled to a lower surface of the mount case 2. An exhaust gas discharged through from the exhaust pipe 30 into an internal space in the extension case 1 is passed through an internal space in the gear case 18 and through the inside of a boss portion of the propeller 20 and discharged into the water. A water pump 31 and an oil pump 32 are mounted at a lower portion and an upper portion of the driving shaft 17, respectively. The water pump 31 supplies the water pumped through the cooling-water pipe 33 into the cooling-water jacket in the engine E. The oil pump 32 supplies an oil pumped from the oil pan 29 to lubricated portions of the engine E.

Figure 3:
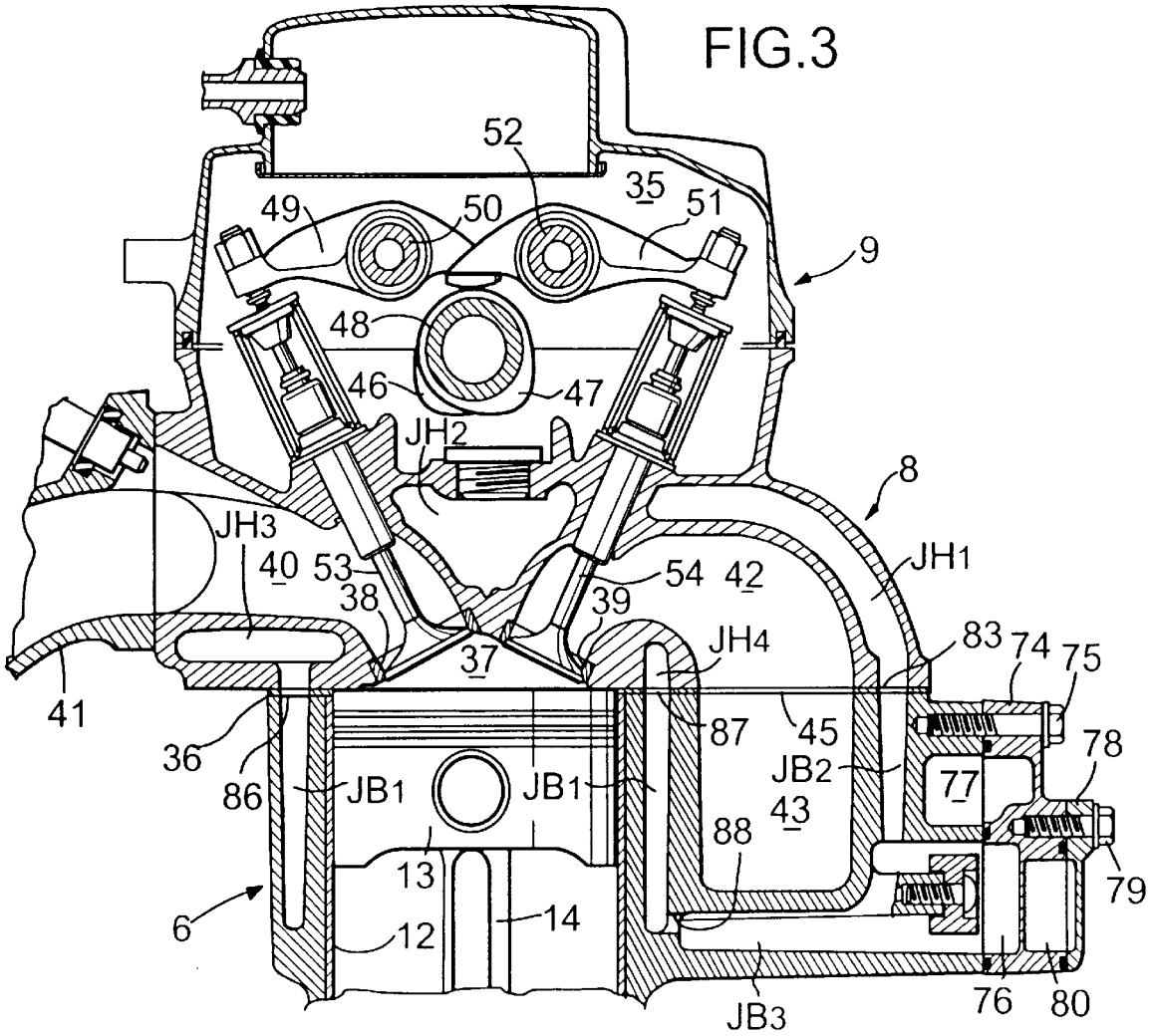
Figure 4:
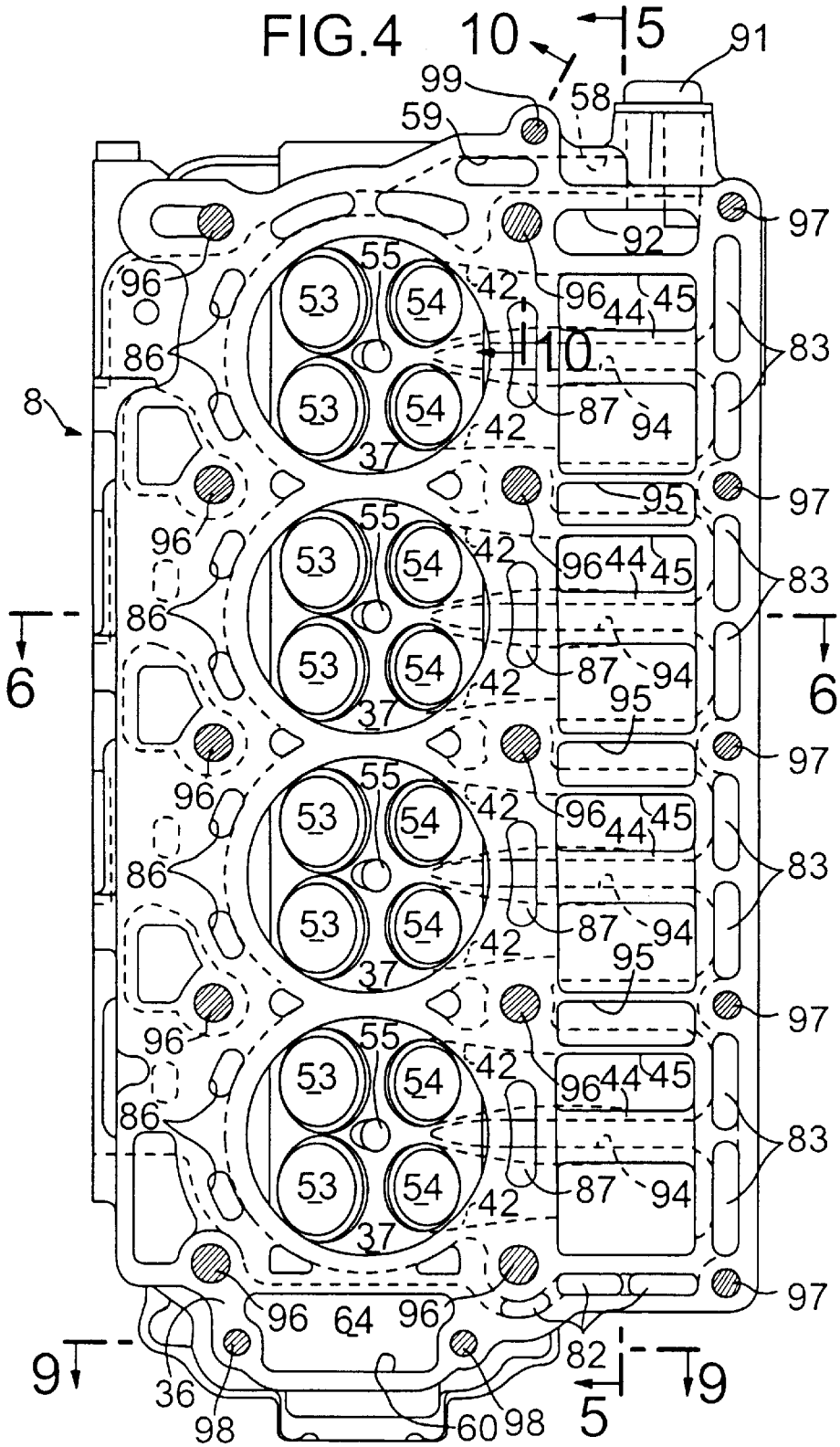

As shown in FIGS. 3 and 4, the cylinder head 8 is provided with four combustion chambers 37 which open into a cylinder block/cylinder head coupling surface 36 which couples the cylinder block 6 and the cylinder head 8 to each other. A pair of intake bores 38 and a pair of exhaust bores 39 are defined in each of the combustion chambers 37. A pair of intake passages 40 extending from the pair of intake bores 38 are connected to an intake manifold 41 at a side of the cylinder head 8. A pair of first exhaust passages 42 extending from the pair of exhaust bores 39 are connected to a common second exhaust passage 43 vertically defined in the cylinder block 6 through an opening 45 in the cylinder block/cylinder head coupling surface 36. A partition wall 44 for partitioning the pair of exhaust passages 40 for each of the combustion chambers 37 terminates slightly short of the opening 45 in the cylinder block/cylinder head coupling surface 36 (see FIG. 5) and hence, the pair of exhaust passages 40 communicate with the second exhaust passage 43 through the common opening 45.

Provided in a valve-operating chamber 35 surrounded by the cylinder head 8 and the head cover 9 are a cam shaft 48 having an intake can 46 and an exhaust cam 47 which correspond to each of the combustion chambers 37, an intake rocker shaft 50 having an intake rocker arm 49 swingably carried thereon, and an exhaust rocker shaft 52 having an exhaust rocker arm 51 swingably carried thereon. The exhaust rocker arm 49 with one end abutting against the intake cam 46 has the other end abutting against a stem end of an intake valve 53 for opening and closing the intake bore 38, while the exhaust rocker arm 51 with one end abutting against the exhaust cam 47 has the other end abutting against a stem end of an exhaust valve 54 for opening and closing the exhaust bore 39. As can be seen from FIG. 6, a tip end of spark plug 55 threadedly mounted in the cylinder head 8 faces a central portion of each of the combustion chambers 37.

Figure 7:
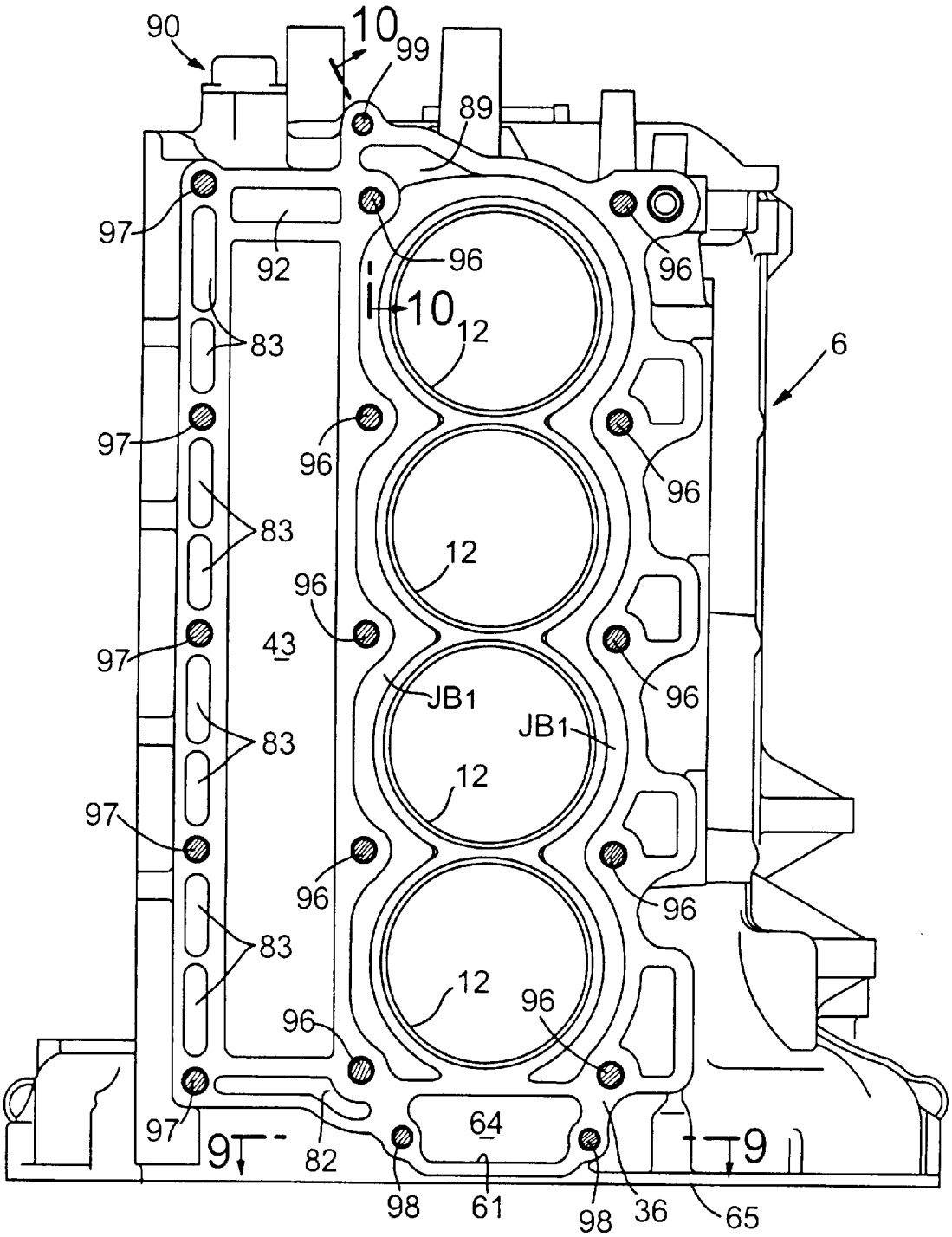
Figure 11:
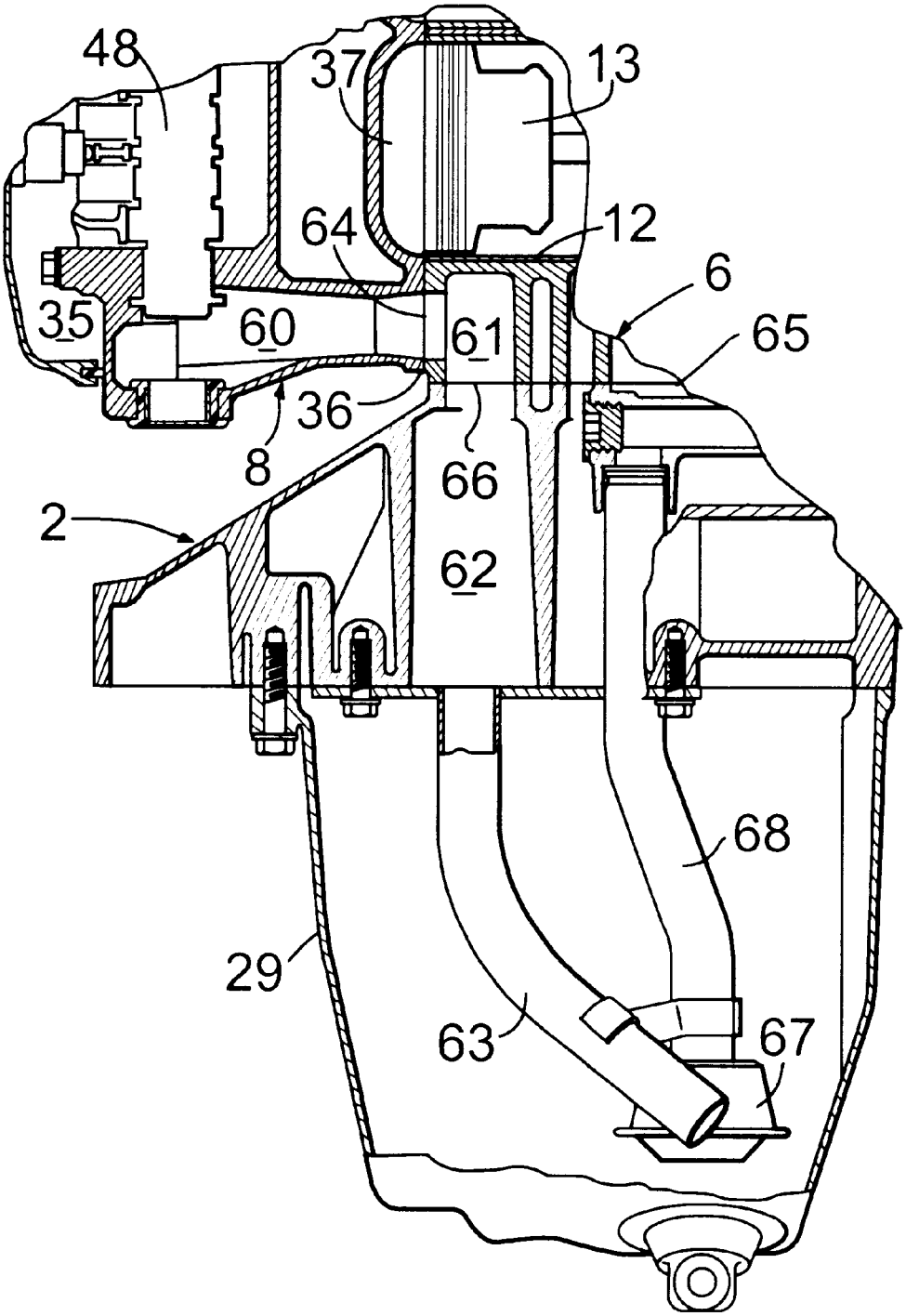

As can be seen from FIGS. 4, 7 and 11, in order to return the oil resident at a lower end of the valve operating chamber 35 to the oil pan 29, the valve operating chamber 35 and the oil pan 29 communicate with each other by a first oil passage 60 defined in the cylinder head 8, a second oil passage 61 defined in the cylinder block 6, a third oil passage 62 defined in the mount case 2 and an oil return pipe 63 fixed to the lower surface of the mount case 2. The second oil passage 61 defined in the cylinder block 6 is bent into an L-shape in section, and communicates at one end thereof with the first oil passage 60 in the cylinder head 8 through an opening 64 (see FIG. 4 and 7) which faces the cylinder block/cylinder head coupling surface 36, and at the other end thereof with the third oil passage 62 in the mount case 2 through an opening 66 (see FIG. 8) which faces a cylinder block/mount case coupling surface 65. In FIG. 11, reference characters 67 and 68 designate a mesh-accommodated strainer and an oil supply pipe connected to the oil pump 32 (see FIG. 1), respectively.

Figure 12:
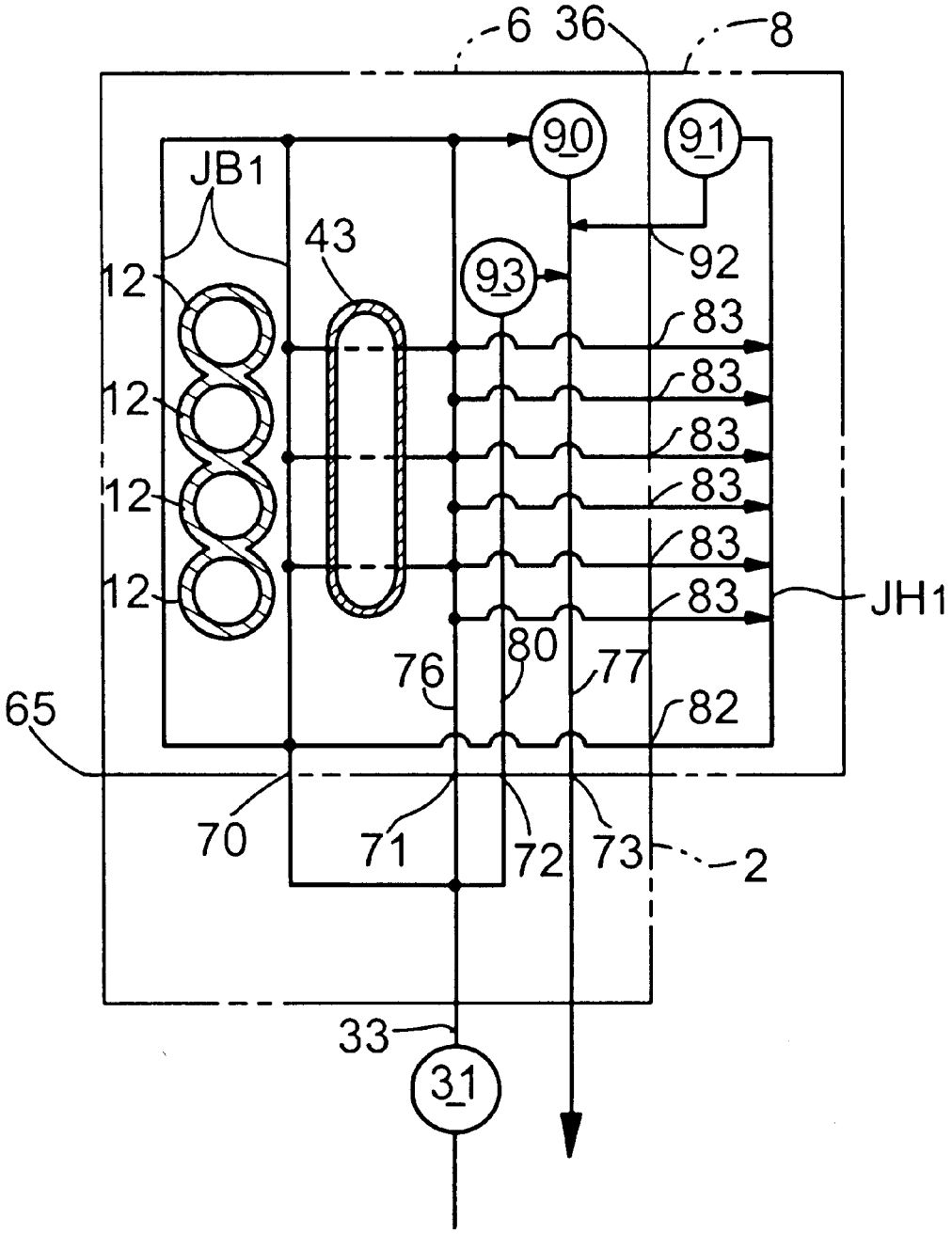

An engine cooling system will be described below with reference to mainly a skeleton diagram in FIG. 12 in combination with FIGS. 3 to 8.

Figure 8:
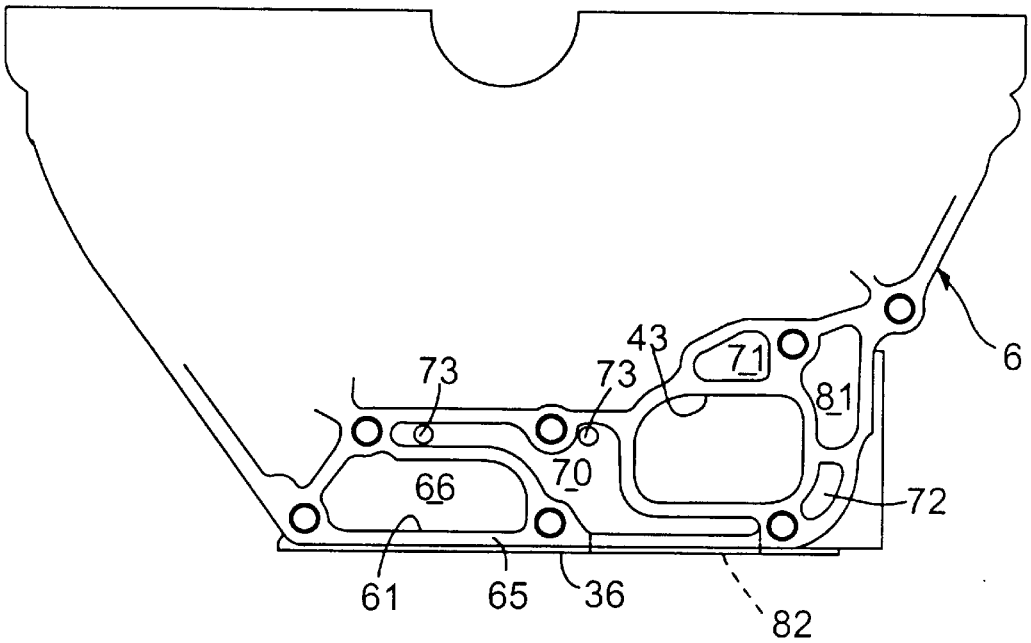

The cooling water pumped by the water pump 31 is passed upwards from below through the mount case 2 to flow into the cylinder block 6 through three openings 70, 71 and 72 defined in the cylinder block/mount case coupling surface 65 (see FIG. 8). A cooling water jacket $JB_1$ (see FIGS. 3 and 7) is defined in the cylinder block 6 to surround outer peripheries of the four cylinders 12, and communicate with the opening 70 through two through-holes 73 (see FIG. 8).

Figure 2:
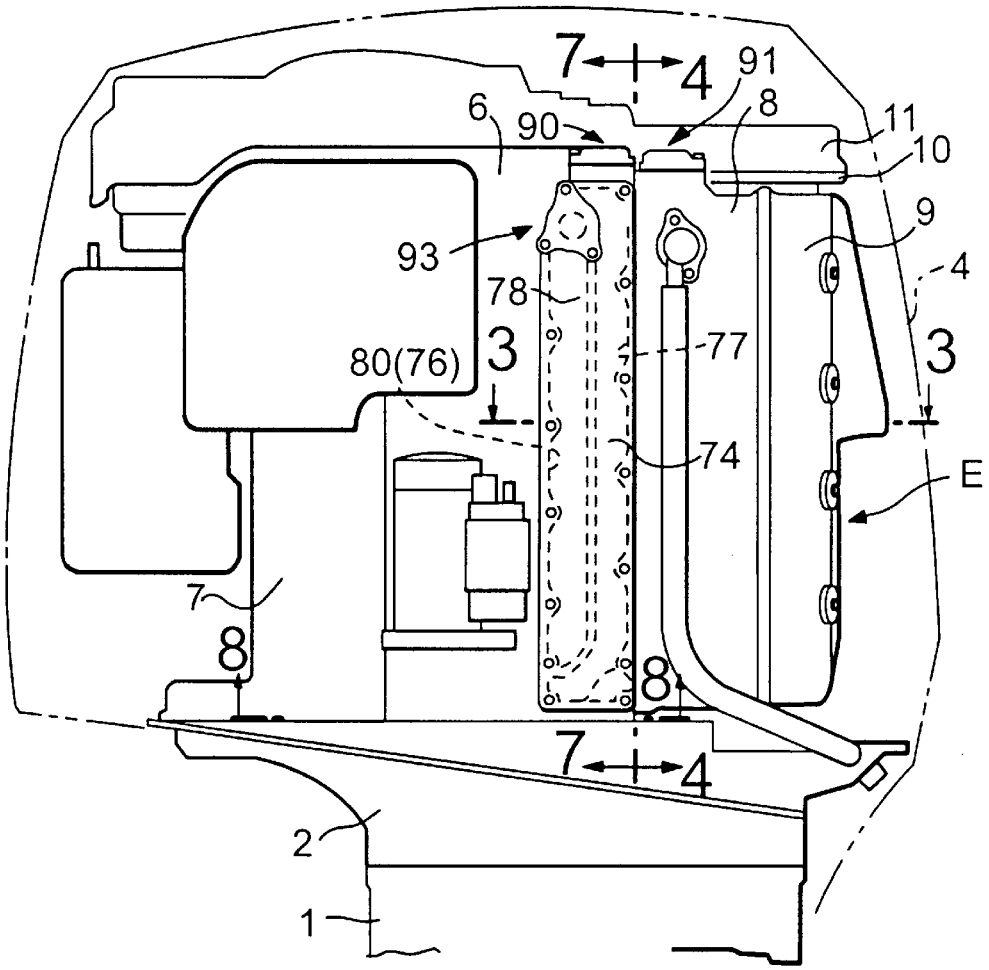

As can be seen from FIGS. 2 and 3, a first cover 74 is fixed to an outer wall surface of the second exhaust passage 43 in the cylinder block 6 by a bolt 75, and a cooling water supply passage 76 and a cooling water discharge passage 77 are defined in parallel to each other between the cylinder block 6 and the first cover 74. A second cover 78 is fixed to the outside of the first cover 74 by a bolt 79, and a relief passage 80 is defined between the first and second covers 74 and 78. A lower end of the cooling water supply passage 76 communicates with the opening 71 defined in the cylinder block/mount case coupling surface 65 (see FIG. 8), while a lower end of the relief passage 80 communicates with the opening 72 defined in the cylinder block/mount case coupling surface 65. An opening 81 is further defined in the cylinder block/mount case coupling surface 65 to communicate with the cooling water discharge passage 77. The four openings 71, 72, 73 and 81 are disposed to surround the periphery of the second exhaust passage 43.

The opening 70 in the cylinder block/mount case coupling surface 65 (see FIG. 8) is bent into an L-shape and communicates with an opening 82 (see FIGS. 4, 5 and 7) in the cylinder block/cylinder head coupling surface 36. The opening 82 communicates with a cooling water jacket $JH_1$ (see FIG. 5) in the cylinder head 8. The cooling water jacket $JH_1$ communicates with the cooling water supply passage 76 through a plurality of openings 83 defined in the cylinder block/cylinder head coupling surface 36 and through a cooling water jacket $JB_2$ defined in the cylinder block 6 (see FIG. 5).

As can be seen from FIG. 3, a cooling water jacket $JH_2$ is vertically defined in a central portion of the cylinder head 8, so that it is surrounded by the intake valves 53 and the exhaust valves 54. The cooling water jacket $JH_2$ communicates with the cooling water jacket $JH_1$ through four through-holes 85 (see FIG. 5). In addition, a cooling water jacket $JH_3$ defined inside the intake passages 40 in the cylinder head 8 communicates with the cooling water jacket $JB_1$ in the cylinder block 6 through openings 86 in the cylinder block/cylinder head coupling surface 36, and a cooling water jacket $JH_4$ defined inside the first exhaust passages 42 in the cylinder head 8 communicates with the cooling water jacket $JB_1$ in the cylinder block 6 through openings 87 in the cylinder block/cylinder head coupling surface 36. Further, a cooling water jacket $JB_3$ is defined in the cylinder block 6 to face the second exhaust passage 43 and also communicates with the cooling water jacket $JB_1$ surrounding the cylinders 12 through a plurality of through-holes 88.

A cooling water passage 89 (see FIG. 7) connected to the cooling water jacket $JB_1$ extending upwards within the cylinder block 6 is connected to the cooling water discharge passage 77 via a first thermo-valve 90 on the upper surface of the cylinder block 6. A cooling water passage 58 (see FIG. 4) connected to the cooling water jacket $JH_1$ extending upwards within the cylinder head 8 is connected to the cooling water discharge passage 77 via a second thermo-valve 91 mounted on the upper surface of the cylinder head 8 and via an opening 92 in the cylinder block/cylinder head coupling surface 36. The cooling water passage 89 in the cylinder block 6 and the cooling water passage 58 in the cylinder head 8 communicate with each other via an opening 59 in the cylinder block/cylinder head coupling surface 36 (see FIGS. 4 and 7). An upper end of the relief passage 80 and an upper end of the cooling water discharge passage 77 are connected to each other through a relief valve 93 (see FIG. 2).

The operation of the cooling system having the above-described arrangement will be described below. During a usual operation which is not a warming operation of the engine E, the cooling water pumped through the cooling water pipe 33 by the water pump 31 diverges in three directions within the mount case 2 and flows through the three openings 70, 71 and 72 in the cylinder block/mount case coupling surface 65 into the cylinder block 6. The cooling water flowing through the opening 70 into the cylinder block 6 flows upwards in the cooling water jacket $JB_1$, while cooling the peripheries of the four cylinders 12. The cooling water flowing through the opening 71 is distributed into the cooling water jackets $JB_2$ and $JB_3$ extending along the second exhaust passage 43 defined in the cylinder block 6 and the cooling water jacket $JH_1$ extending along the first exhaust passage 42, while flowing upwards in the cooling water supply passage 76 defined between the cylinder block 6 and the first cover 74, thereby cooling the peripheries of the first and second exhaust passages 42 and 43. A portion of the cooling water flowing through the opening 70 into the cylinder block 6 flows through the opening 82 in the cylinder block/cylinder head coupling surface 36 into the cylinder head 8, and is then joined with the cooling water distributed from the cooling water supply passage 76 and flows upwards in the cooling water jacket $JH_1$ in the cylinder head 8 to cool the peripheries of the first exhaust passages 42.

The cooling water portions passed through the first and second thermo-valves 90 and 91 mounted respectively at the upper ends of the cylinder block 6 and the cylinder head 8 are joined with each other, and flow downwards in the cooling water discharge passage 77, and then, are discharged into the extension case 1. If the pressure of water discharged from the water pump 31 is increased to exceed a predetermined value, the relief valve 93 mounted in the relief passage 80 is opened, permitting the surplus cooling water to be discharged into the cooling water discharge passage 77.

On the other hand, during the warming operation of the engine E, the first and second thermo-valves 90 and 91 are in their closed states to inhibit the flowing of the cooling water portions existing within the cooling water jackets $JB_1$ to $JB_3$ in the cylinder block 6 and the cooling water jackets $JH_1$ to $JH_4$ in the cylinder head 8, and hence, the warming of the engine E is promoted. Even when the throttle opening degree is increased during the warming operation, so that the pressure of water discharged from the water pump 31 is increased to exceed the predetermined value, the relief valve 93 is opened, causing the surplus cooling water to be discharged into the cooling water discharge passage 77. When the warming of the engine E is completed and the first and second thermo-valves 90 and 91 are opened, the cooling water jackets $JB_1$ to $JB_3$ and $JH_1$ to $JH_4$ communicate with the cooling water discharge passage 77, passing to a state during the usual operation.

The shape of the cooling water jacket $JH_1$ in the cylinder head 8 will be described below in further detail with reference to FIGS. 3 to 6.

Figure 5:
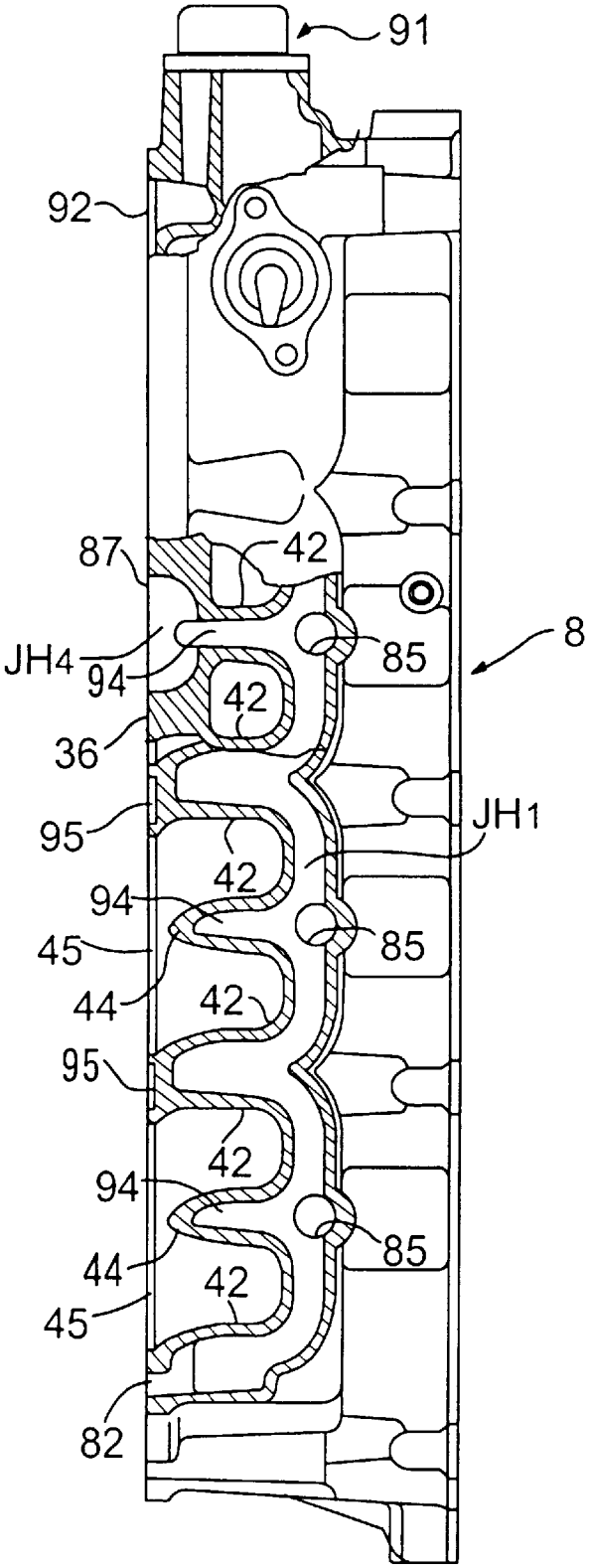
Figure 6:
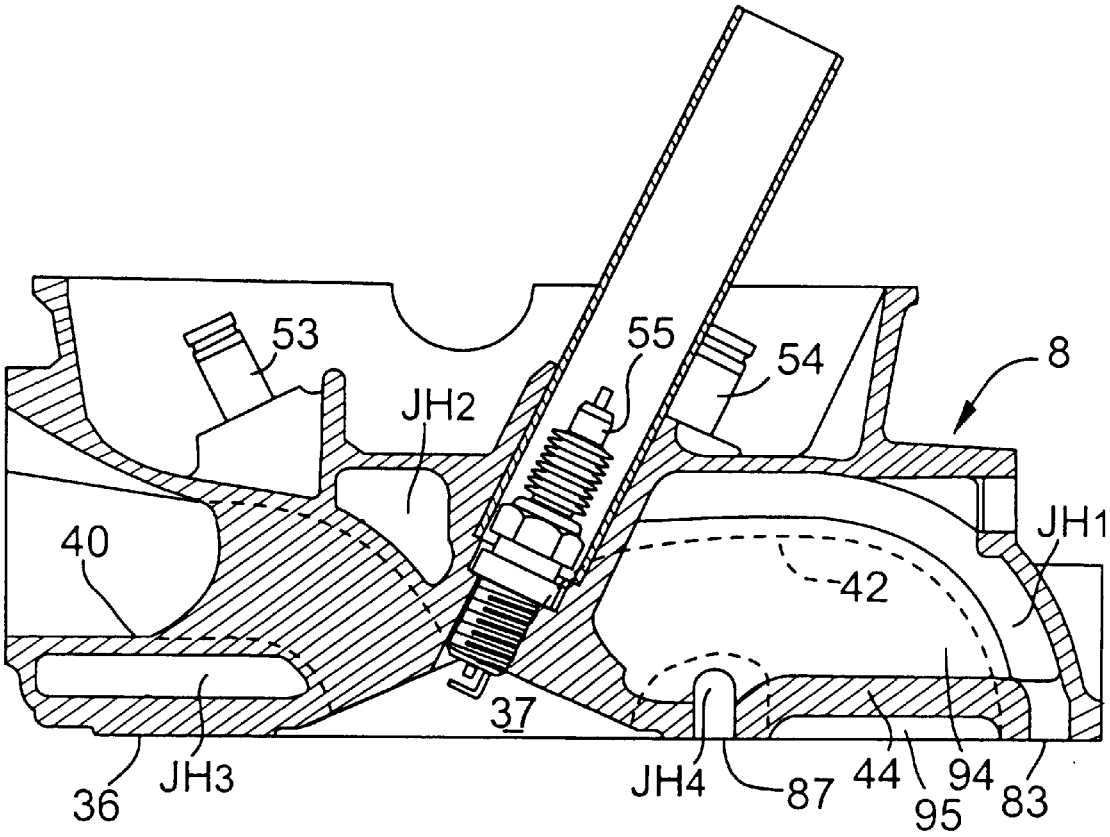

The cooling water jacket $JH_1$ is intended to cool the first exhaust passages 42 defined in the cylinder head 8 and portions near the combustion chambers 37 and formed using a core in producing the cylinder head 8 in a casting process. As best shown in FIGS. 5 and 6, the cooling water jacket $JH_1$ includes an intra-wall passage 94 extending in the partition wall 44 which partitions the pair of adjacent first exhaust passages 42. The intra-wall passage 94 extends to near the combustion chamber 37 and the spark plug 55. The intra-wall passage 94 is connected, at its portion remoter from the combustion chamber 37, to the opening 83 in the cylinder block/cylinder head coupling surface 36 and communicates, at its portion nearer to the combustion chamber 37, with the cooling water jacket $JH_4$.

By the fact that those portions of the cylinder head 8 which are near the first exhaust passages 42, the combustion chamber 37 and the spark plug 55 and are heated to a highest temperature are surrounded in the above manner by the cooling water jacket $JH_1$ including the intra-wall passage 94 and the cooling water jacket $JH_4$ which permits the cooling water jacket $JH_1$ to be put into communication with the cooling water jacket $JB_1$ in the cylinder block 6 via the through-holes 87, the highest-temperature portions can be effectively cooled.

In FIG. 5, in producing the cylinder head 8 in the casting process, the cooling water jacket $JH_1$ is formed using the core and the cooling water jacket $JH_4$ is formed using a mother die. Provided that the cooling water jackets $JH_1$ and $JH_4$ are formed using the same core, the structure of a die forming such core is complicated. However, if the cooling water jacket $JH_4$ is independently formed in the mother die, the core forming die for forming the cooling water jacket $JH_1$ can be simplified. In FIGS. 4 and 6, reference character 95 designates a recess defined in the cylinder block/cylinder head coupling surface 36 and formed in the mother die simultaneously when the cooling water jacket $JH_4$ is formed.

The cylinder block 6 and the cylinder head 8 are abutted against each other in the cylinder block/cylinder head coupling surface 36 and integrally coupled to each other by ten bolts 96 inserted from the side of the cylinder head 8. As can be seen from FIGS. 4 and 7, four of the bolts 96 are disposed concentrically with respect to a center line of each of the cylinders 12, and two of the bolts 96 are used commonly for the adjacent two cylinders 12. Further, the cylinder block 6 and the cylinder head 8 are integrally coupled to each other with the second exhaust passage 43 sandwiched therebetween on the opposite side from the cylinders 12 by five bolts 97 inserted from the side of the cylinder head 8.

A sufficient force is obtained at a location radially inside the ten bolts 96 coupling the cylinder block 6 and the cylinder head 8 as viewed from the cylinder axes, i.e., at a location corresponding to the cooling water jacket $JB_1$ surrounding the cylinders 12, but only the fastening force of the bolts 96 must be relied on at a location radially outside the ten bolts 96 as viewed from the cylinder axes, particularly, at the lower and upper ends of the cylinder block 6 and the cylinder head 8, which are opposite ends in a direction of arrangement of the four cylinders 12. Therefore, when the opening of the oil passage or the cooling water passage is formed radially outside, there is a problem that such opening cannot be made large, or the radially outward protrusion is limited.

For example, as shown in FIGS. 4 and 7, the opening 64 of the oil passage and the opening 82 of the cooling water passage are formed so as not to stay radially inside the bolts 96 as viewed from the center line of the cylinders 12, in the cylinder block/cylinder head coupling surface 36 at the lower ends of the cylinder block 6 and the cylinder head 8. The shapes, positions and the like of the openings 64 and 82 are limited in design not only being limited in order to meet demands for performance.

Figure 9:
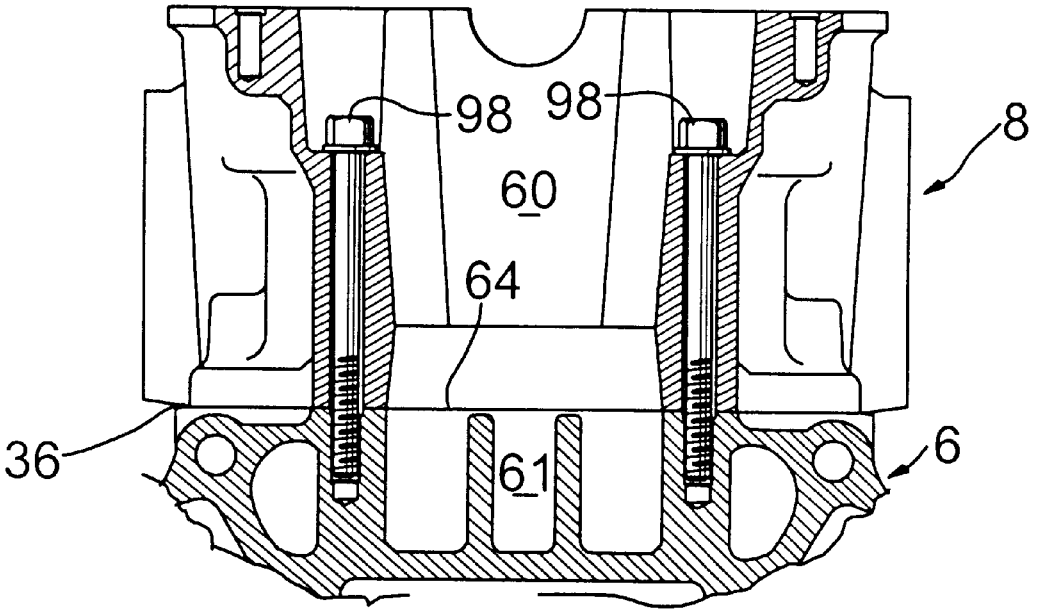

However, by the fact that the cylinder block 6 and the cylinder head 8 are fastened by two bolts 98 located radially outside the bolts 96 surrounding the outer peripheries of the cylinders 12 at locations adjacent the opposite ends of the opening 64 of the oil passage, as shown in FIG. 9, the sealability of the cylinder block/cylinder head coupling surface 36 is enhanced, and the limitation of the shape, position and the like of the openings 64 and 82 is eliminated. Particularly, one of the two bolts 98 is disposed to intervene between the opening 64 of the oil passage and the opening 82 of the cooling water passage 82 adjacent the opening 64, as shown in FIG. 7 and hence, the fastening force therebetween can be sufficiently increased.

As shown in FIGS. 4 and 7, the opening 59 for communication between the cooling water passage 89 in the cylinder block 6 and the cooling water passage 58 in the cylinder head 8 is formed in the cylinder block/cylinder head coupling surface 36 at the upper ends of the cylinder block 6 and the cylinder head 8, so that it is located radially outside the bolts 96 as viewed from the center line of the cylinders 12. Therefore, the shape, position and the like of the opening 58 are limited.

Figure 10:
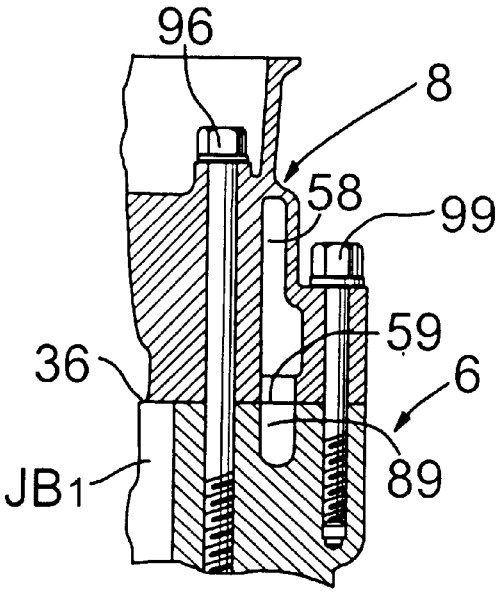

However, by the fact that the cylinder block 6 and the cylinder head 8 are fastened by a single bolt 99 located radially outside the bolts 96 surrounding the outer peripheries of the cylinders 12 in the vicinity of the opening 59 between the cooling water passages 89 and 58, as shown in FIG. 10, the sealability of the cylinder block/cylinder head coupling surface 36 is enhanced. Therefore, the limitation of the shape, position and the like of the opening 59 can be eliminated to enhance the degree of freedom in design.

Although the embodiment of the present invention has been described in detail, it will be understood that the present invention is not limited to the above-described embodiment, and various modifications in design may be made without departing from the spirit and scope of the present invention defined in claims.

For example, the in-line type 4-cylinder engine is illustrated in the embodiment, but the present invention is applicable to any engine for an outboard engine system, in which the number and the arrangement of the cylinders are different from those in the above-described engine. The engine having the oil pump 32 mounted on the driving shaft 17 is illustrated in the embodiment, but the present invention is applicable to an engine having an oil pump mounted on a cam shaft. In this case, an oil supply passage connected to the oil pump and an oil discharge passage open into the cylinder block/cylinder head coupling surface and hence, the degree of freedom in design such as the position and shape of such opening can be enhanced.

What is claimed is:

1. An engine for an outboard engine system, comprising a cylinder head coupled to a cylinder block by a plurality of first coupling bolts disposed at substantially equal distances from a cylinder axis so as to surround an outer periphery of a cylinder, and an oil passage having an opening which is defined in a cylinder head/cylinder block coupling surface at a location radially outside said first coupling bolts as viewed from the cylinder axis, wherein said cylinder head is fastened to said cylinder block by second coupling bolts disposed radially outside said first coupling bolts as viewed from the cylinder axis in the vicinity of the opening of said oil passage.

2. An engine for an outboard engine system according to claim 1, further including an opening of a cooling water passage, which is defined in said cylinder head/cylinder block coupling surface, and one of said second coupling bolts is disposed between the opening of said cooling water passage and the opening of said oil passage.

* * * * *